US010758923B1

(12) United States Patent
Oman et al.

(10) Patent No.: US 10,758,923 B1
(45) Date of Patent: Sep. 1, 2020

(54) IRRIGATION DEVICES AND METHODS

(71) Applicant: Orbit Irrigation Products, LLC, North Salt Lake, UT (US)

(72) Inventors: Carter Timothy Oman, Spring Creek, NV (US); Hugo Rodriguez, Lake Oswego, OR (US); Karl L. Connolly, Bountiful, UT (US); Andrew Mark Urry, Riverton, UT (US); Eric Tres Wangsgaard, Salt Lake City, UT (US)

(73) Assignee: Orbit Irrigation Products, LLC, North Salt Lake, UT (US)

( * ) Notice: Subject to any disclaimer, the term of this patent is extended or adjusted under 35 U.S.C. 154(b) by 340 days.

(21) Appl. No.: 15/799,971

(22) Filed: Oct. 31, 2017

(51) Int. Cl.
*B05B 3/04* (2006.01)
*B05B 1/16* (2006.01)
*B05B 15/622* (2018.01)

(52) U.S. Cl.
CPC ..... *B05B 3/0463* (2013.01); *B05B 1/16* (2013.01); *B05B 15/622* (2018.02)

(58) Field of Classification Search
CPC ..... B05B 3/0463; B05B 15/622; B05B 1/16
USPC ..... 239/276
See application file for complete search history.

(56) References Cited

U.S. PATENT DOCUMENTS 2,414,052 A * 1/1947 Martin ..... B05B 15/70 239/206
2,571,763 A * 10/1951 Robbins ..... B05B 1/262 239/601
2,739,839 A * 3/1956 Greener ..... B05B 3/026 239/97
3,391,868 A 7/1968 Cooney
4,265,403 A * 5/1981 Bonetti ..... A01G 25/162 137/624.14
4,613,077 A * 9/1986 Aronson ..... B05B 3/0454 239/236

(Continued)

OTHER PUBLICATIONS

Nelson, Nelson Contour Master Pulsating Sprinkler 50216, Product No. 50216, web page, Amazon online catalog, published at least by Oct. 17, 2010, Retrieved from the Internet: <URL: https://www.amazon.com/Nelson-Contour-Pulsating-Sprinkler-50216/dp/B003UNJYBK#customerReviews> (shown in attachment 1).
Gilmour, Gilmour 996 Pattern Master Pulsating Sprinkler, Product No. 996, web page, Amazon online catalog, published at least by Jul. 31, 2000, Retrieved from the Internet: <URL: https://www.amazon.com/Gilmour-996-Pattern-Pulsating-Sprinkler/dp/B00002N8KN> (shown in attachment 2).

(Continued)

*Primary Examiner* — Chee-Chong Lee
(74) *Attorney, Agent, or Firm* — Austin Rapp

(57) ABSTRACT

An irrigation sprinkler is described. The irrigation sprinkler includes a first ring including a first edge defining a first plurality of semicircular recesses and a second ring including a second edge defining a second plurality of semicircular recesses. The first ring and the second ring are secured together to define a plurality of circular recesses. The first ring includes a fin proximate each circular recess. The irrigation sprinkler also includes an adjustment mechanism disposed within each of the circular recesses. Each adjustment mechanism includes an outer rotating member including an annular structure comprising at least one of an annular recess and an annular protrusion, and an internal chamber including inwardly disposed threads. Each adjustment mechanism also includes an inner cylindrical member including an outer surface. The outer surface defines outwardly disposed threads and a channel. The channel extends radially along only a portion of the inner cylindrical member.

12 Claims, 9 Drawing Sheets

(56) References Cited

U.S. PATENT DOCUMENTS

| | | | | |
|---|---|---|---|---|
| D297,255 | S | 8/1988 | Henken | |
| 4,819,875 | A * | 4/1989 | Beal | B05B 3/0454 239/97 |
| 5,199,646 | A | 4/1993 | Kah | |
| 7,303,148 | B2 | 12/2007 | Campbell | |
| D607,085 | S | 12/2009 | Nies | |
| 8,113,443 | B2 | 2/2012 | Zur | |
| 8,684,283 | B2 | 4/2014 | Nies | |
| 9,149,827 | B2 | 10/2015 | Anuskiewicz | |
| 9,616,437 | B2 | 4/2017 | Onofrio | |
| D819,170 | S | 5/2018 | Vallo | |
| D857,161 | S | 8/2019 | Oman | |
| 2011/0259975 | A1* | 10/2011 | Lo | B05B 1/262 239/99 |

OTHER PUBLICATIONS

Notice of Allowance and Fee(s) Due (including a Notice of Allowability For A Design Application section, and an Examiner's Amendment section), U.S. Appl. No. 29/624,408, dated Dec. 12, 2018 (shown in attachment 3).

Amendment After Allowance, U.S. Appl. No. 29/624,408, dated Mar. 5, 2019 (shown in attachment 4).

Continued Prosecution Application Request, U.S. Appl. No. 29/624,408, Dated Mar. 12, 2019 (shown in attachment 5).

Notice of Allowance and Fee(s) Due (including a Notice of Allowability for a Design Application section), U.S. Appl. No. 29/624,408, dated Mar. 26, 2019 (shown in attachment 6).

U.S. Appl. No. 29/624,408, filed Oct. 31, 2017, Oman.

* cited by examiner

IRRIGATION DEVICES AND METHODS

TECHNICAL FIELD

The present invention relates generally to irrigation devices. More specifically, the present invention relates to an irrigation sprinkler.

BACKGROUND

Irrigation sprinklers are used to, for example, deliver water to a lawn or garden area. However, improvements in usability, functionality, and manufacturability of irrigation sprinklers are desirable.

SUMMARY

Embodiments of the disclosed subject matter are provided below for illustrative purposes and are in no way limiting of the claimed subject matter.

An irrigation sprinkler is described. The irrigation sprinkler includes a first ring including a first edge defining a first plurality of semicircular recesses. The irrigation sprinkler also includes a second ring including a second edge defining a second plurality of semicircular recesses. A portion of each of the first edge and the second edge are shaped and sized to be secured together. The first ring and the second ring are secured together with each of the first plurality of semicircular recesses aligned with one of the second plurality of semicircular recesses to define a plurality of circular recesses. The first ring includes a fin proximate each circular recess. The irrigation sprinkler further includes an adjustment mechanism disposed within each of the circular recesses. Each adjustment mechanism includes an outer rotating member including an external surface defining an annular structure including at least one of an annular recess and an annular protrusion. The outer rotating member includes an internal surface defining an internal chamber. The internal surface includes inwardly disposed threads. Each adjustment mechanism also includes an inner cylindrical member including an outer surface. The inner cylindrical member includes a radially inward end and a radially outward end disposed at opposite ends of the inner cylindrical member along a radial axis of the inner cylindrical member. The outer surface defines outwardly disposed threads that engage the inwardly disposed threads. The outer surface defines a channel, the channel extending radially along only a portion of the inner cylindrical member.

Each fin may be disposed within the channel of an engaged one of the inner cylindrical members. Each inner cylindrical member may include a surrounding portion that surrounds each channel. The surrounding portion may have a size and shape such that contact between the fin and the surrounding portion of the engaged one of the inner cylindrical members limits rotational movement of the engaged one of the inner cylindrical members. The surrounding portion of each inner cylindrical member may include a stop surface that defines an enclosed end of each channel. The stop surface may have a position, size, and shape to limit relative movement between the fin and the engaged one of the inner cylindrical members along the radial axis of the engaged one of the inner cylindrical members.

Each inner cylindrical member may include a set of wings disposed at the radially inward end. Each set of wings may define a curved surface at each radially inward end. The sets of wings may collectively define a piecewise adjustable curved surface within the first ring and the second ring.

The irrigation sprinkler may include a rotational spray control mechanism. The rotational spray control mechanism may engage with the piecewise adjustable curved surface to control flow and spray angle.

Each annular structure may engage with one of the circular recesses allowing rotational movement of each outer rotating member and limiting radial movement of each outer rotating member.

The external surface of each outer rotating member may include an outward manipulation surface. The outward manipulation surface may define a plurality of indentations.

Each outer rotating member may include an outer wall defining an opening. Each inner cylindrical member may include a gauge arm situated within one of the openings. Each opening may be smaller than each outer surface defining outwardly disposed threads.

A method of manufacturing the irrigation sprinkler is also described. The method may include engaging the inwardly disposed threads of the outer rotating member with the outwardly disposed threads of the inner cylindrical member for each of the adjustment mechanisms. The method may also include positioning the annular structure to engage with a vacant one of the first plurality of semicircular recesses of the first ring for each of the adjustment mechanisms. The method may further include positioning the channel of the inner cylindrical member such that the fin proximate the vacant one of the first plurality of semicircular recesses is disposed within the channel of the inner cylindrical member for each of the adjustment mechanisms. The method may additionally include, after one of the adjustment mechanisms is positioned within each one of the first plurality of semicircular recesses, securing a portion of the first edge to a portion of the second edge such that each of the first plurality of semicircular recesses is aligned with one of the second plurality of semicircular recesses to form the plurality of circular recesses and such that each of the second plurality of semicircular recesses is positioned to engage with the annular structure of one of the outer rotating members.

BRIEF DESCRIPTION OF THE DRAWINGS

Various embodiments of the invention will become apparent from the following description and appended claims, taken in conjunction with the accompanying drawings. Understanding that these drawings depict only examples of the invention thereof and are, therefore, not to be considered limiting of the invention's scope, particular embodiments will be described with additional specificity and detail through use of the accompanying drawings in which:

Figure 1A:
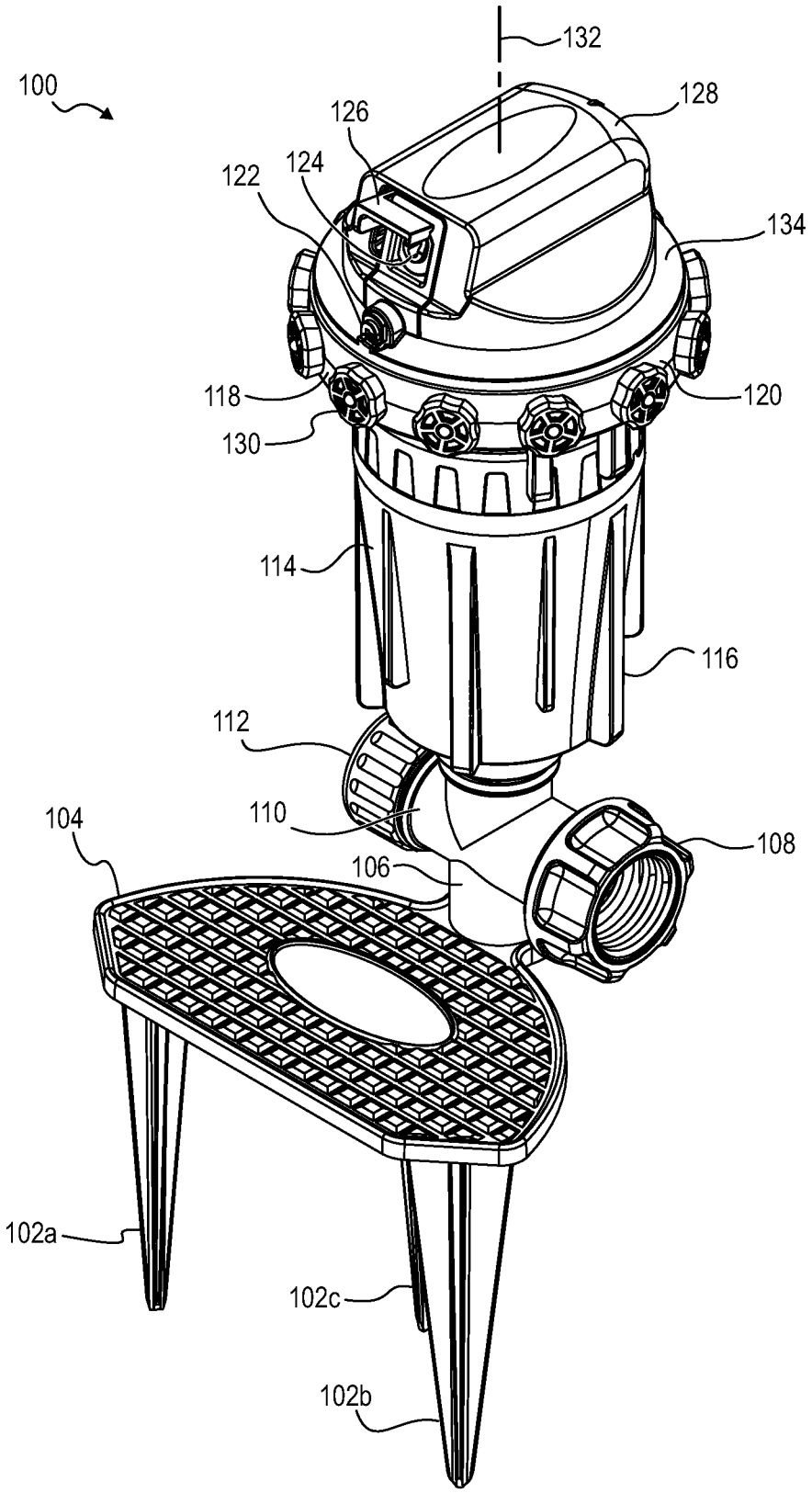
FIG. 1A is a perspective view of one embodiment of an irrigation sprinkler.

In accordance with common practice, the various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus (e.g., device) or method. Finally, like reference numerals may be used to denote like features throughout the specification and figures.

DETAILED DESCRIPTION

Various aspects of the present disclosure are described below. It should be apparent that the teachings herein may be embodied in a wide variety of forms and that any specific structure, function, or both disclosed herein is merely representative. Based on the teachings herein, one skilled in the art should appreciate that an aspect disclosed herein may be implemented independently of any other aspects and that two or more of these aspects may be combined in various ways, even if not specifically illustrated in the figures. For example, an apparatus may be implemented, or a method may be practiced, using any number of the aspects set forth herein whether disclosed in connection with a method or an apparatus. Further, the disclosed apparatuses and methods may be practiced using structures or functionality known to one of skill in the art at the time this application was filed, although not specifically disclosed within the application.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

As used in this application, the phrases "an embodiment" or "in one embodiment" or the like do not refer to a single, specific embodiment of the disclosed subject matter. Instead, these phrases signify that the identified portion or portions of the disclosed subject matter may be combined with other aspects of the disclosure without limitation.

For this application, the phrases "connected to," "coupled to," and "in communication with" refer to any form of interaction between two or more entities, including mechanical, electrical, magnetic, electromagnetic, and thermal interaction and may also include integral formation. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion.

The phrase "substantially coaxially aligned," as used herein, signifies that the pertinent members, components, or items that are "substantially coaxially aligned" with each other are within 2°, 3°, 5°, 7°, 10° or 15° of being perfectly coaxially aligned with each other. As used herein the term "substantially coaxially aligned" may signify that two items are aligned such that they share a common, imaginary axis (or within 2°, 3°, 5°, 7°, 10° or 15° of sharing the same common, imaginary axis) extending through both of the items, although the items may be spaced apart along that common, imaginary axis.

In the figures, certain components may appear many times within a particular drawing. However, only certain instances of the component may be identified in the figures to avoid unnecessary repetition of reference numbers and lead lines. According to the context provided in the description while referring to the figures, reference may be made to a specific one of that particular component or multiple instances, even if the specifically referenced instance or instances of the component are not identified by a reference number and lead line in the figures.

As used in this application, the term "proximate" signifies being next to, near, partially within, and/or completely within. In various embodiments, "proximate" may mean that one element is immediately adjacent to another element, or is within 1 millimeter (mm), 2 mm, 3 mm, 5 mm, or 10 mm from another element.

Figure 1B:
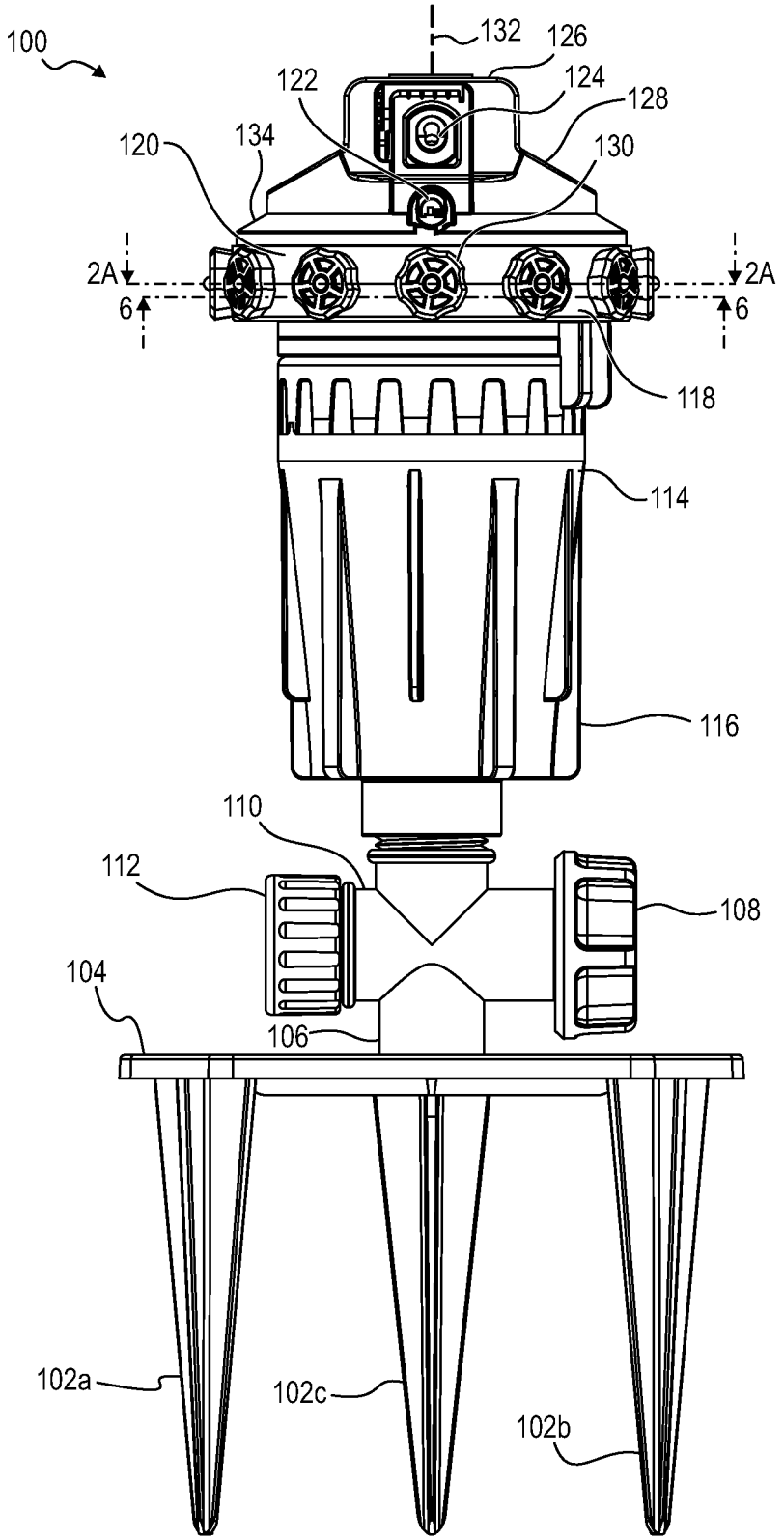
FIG. 1B is a front side elevational view of the irrigation sprinkler illustrated in FIG. 1A.

FIGS. 1A and 1B will be discussed concurrently. FIG. 1A is a perspective view of one embodiment of an irrigation sprinkler 100, while FIG. 1B is a front side elevational view of the irrigation sprinkler 100. In the discussion below related to FIGS. 1A and 1B, the referenced parts are illustrated and identified in either both or only one of FIGS. 1A and 1B to avoid unnecessary proliferation of reference numerals. As illustrated in FIGS. 1A and 1B, the irrigation sprinkler 100 may include three stakes 102*a-c*, a support plate 104, and a support member 106. The stakes 102*a-c* may secure the irrigation sprinkler 100 to a surface, for example, soil, and/or grass. For instance, the stakes 102*a-c* may be driven into the ground to secure the irrigation sprinkler 100 to the ground. The support plate 104 and support member 106 may support the irrigation sprinkler 100. For example, the support plate 104 and support member 106 may hold the irrigation sprinkler 100 in an orientation relative to the underlying surface. In various embodiments, the support plate 104 may be utilized to drive the stakes 102*a-c* into the surface, for example, by means of pressing weight on the support plate 104 (e.g., a user stepping on the support plate 104 and/or pounding the support plate 104 with a tool, such as a mallet).

The support member 106 may include a hollow channel, a conduit, for delivering fluid. For example, the support member 106 may be or include a pipe that allows fluid to flow through the support member 106. The support member 106 may include or be coupled to a fluid input coupling 108. The fluid input coupling 108 may be connected to a source of pressurized fluid (e.g., water) through, for example, a hose tap, or spigot. In various embodiments, the fluid input coupling 108 may include threads for connecting a source to the fluid input coupling 108. Hose taps or spigots are often located adjacent to or on the exterior of a home or business, although hose taps and spigots may be located elsewhere, such as adjacent to an agricultural area or a flower bed. In various embodiments, the irrigation sprinkler 100 may include one or more control mechanisms (e.g., valves) that control whether, and to what extent, pressurized fluid entering through the fluid input coupling 108 flows through the irrigation sprinkler 100.

In various embodiments, the support member 106 may include or be coupled to a fluid output coupling 110. The fluid output coupling 110 may allow fluid to flow through the support member 106 (without passing through a casing 114, for example). In some cases, the fluid output coupling 110 may be connected to a conduit (e.g., a hose or pipe) to allow all or part of the pressurized fluid flowing into the irrigation sprinkler 100 to flow to the conduit. For example, the pressurized fluid may flow through the conduit to another irrigation sprinkler or a fluid drain. In some cases, the fluid output coupling 110 may be coupled to a cap 112. The cap 112 may prevent pressurized fluid from flowing out of the fluid output coupling 110. In various embodiments, the fluid output coupling 110 may include threads for connecting a cap 112 or conduit to the fluid output coupling 110.

In alternative embodiments (not illustrated), the sprinkler 100 may be devoid of stakes 102*a-c*, a support plate 104, and a support member 106 and may include a fluid input coupling and/or fluid output coupling, either threaded or unthreaded, for connection to a conduit. These types of couplings, may, for example, be incorporated into the casing 114 of the sprinkler 100. The sprinkler 100 thus may be embodied, for example, as a pop-up, in-ground sprinkler. In various embodiments, the stakes 102*a-c*, a support plate 104, and a support member 106 may comprise an integrally or non-integrally formed member having threads that may engage with a threaded portion of the casing 114.

As illustrated in FIGS. 1A and 1B, the irrigation sprinkler 100 may include a casing 114. The casing 114 may hold, support, and/or house one or more irrigation sprinkler components. The casing 114 may be attached to the support member 106. In various embodiments, the casing 114 may include one or more protrusions 116. The protrusions 116 may facilitate manipulation of the casing 114 and the irrigation sprinkler 100. For example, the protrusions 116 may provide a grip for manually attaching the casing 114 to the support member 106. In various embodiments, the support member 106 may include threads for attaching the casing 114 to the support member 106.

The irrigation sprinkler 100 may include a first ring 118. The first ring 118 may include a first edge defining a first plurality of semicircular recesses (illustrated in greater detail and identified with reference numerals in FIG. 7A). The first ring 118 may be attached to the casing 114. The irrigation sprinkler 100 may include a second ring 120. The second ring 120 may include a second edge defining a second plurality of semicircular recesses (illustrated in greater detail and identified with reference numerals in FIG. 7B). A portion of each of the first edge and the second edge are shaped and sized to be secured together. For example, the edges between the semicircular recesses may be shaped and sized to be secured together. The first ring 118 and the second ring 120 may be secured together with each of the first plurality of semicircular recesses aligned with one of the second plurality of semicircular recesses to define a plurality of circular recesses. For example, a portion of the first edge and a portion of the second edge may be secured together by vibration welding (e.g., ultrasonic welding), adhesives, press fit, snap fit, and/or other securing means. In various embodiments, the first ring 118 may include a fin (not shown in FIGS. 1A and 1B) proximate each circular recess. For example, each fin may be proximate one of the circular recesses within the first ring 118. In addition to or alternatively from the definition of "proximate" given above, a fin that is "proximate" one of the circular recesses may be closer to that particular circular recess than any other fin.

The irrigation sprinkler 100 may include a plurality of adjustment mechanisms 130. The irrigation sprinkler 100 may, for example, include twelve adjustment mechanisms 130. In other examples, other numbers of adjustment mechanisms may be included in the irrigation sprinkler 100. Each adjustment mechanism 130 may be disposed within one of the circular recesses. Each adjustment mechanism 130 may serve to set and adjust flow (e.g., flow amount) and/or spray angle (e.g., upward and downward spray angle) of the irrigation sprinkler 100. More detail regarding the adjustment mechanisms 130 is given in relation to FIG. 2A through FIG. 7.

The irrigation sprinkler 100 may include a rotational spray control mechanism 134. The rotational spray control mechanism 134 may be pivotally attached to the second ring 120 and/or to the first ring 118. The rotational spray control mechanism 134 may be substantially coaxially aligned with the second ring 120, with the first ring 118, and/or the casing 114. For example, the rotational spray control mechanism 134 may rotate around a first axis 132 (e.g., a height axis) of the second ring 120 and/or of the first ring 118.

The irrigation sprinkler 100 (e.g., the rotational spray control mechanism 134) may include a first nozzle 124. The first nozzle 124 may spray pressurized fluid (e.g., water). The irrigation sprinkler 100 may include a spray deflector 126. The spray deflector 126 may deflect the pressurized fluid (e.g., water) being sprayed from the first nozzle 124. For example, the spray deflector 126 may be adjustable to deflect the pressurized fluid to varying upward or downward degrees, if at all. In various embodiments, the adjustment mechanism 130 that is opposite from the current rotational spray direction may set a deflection angle of the spray deflector 126, which may be controlled by the rotational spray control mechanism 134.

In various embodiments, the irrigation sprinkler 100 (e.g., the rotational spray control mechanism 134) may include a second nozzle 122. The second nozzle 122 may spray pressurized fluid (e.g., water). For example, the second nozzle 122 may spray a second stream of pressurized fluid at a different angle (e.g., a lower angle) from the first nozzle 124.

In various embodiments, the irrigation sprinkler 100 may include a cover 128. The cover 128 may cover the rotational spray control mechanism 134. The cover 128 may be attached to the rotational spray control mechanism 134. The cover 128 may be removable to access an interior portion of the rotational spray control mechanism 134.

Figure 2A:
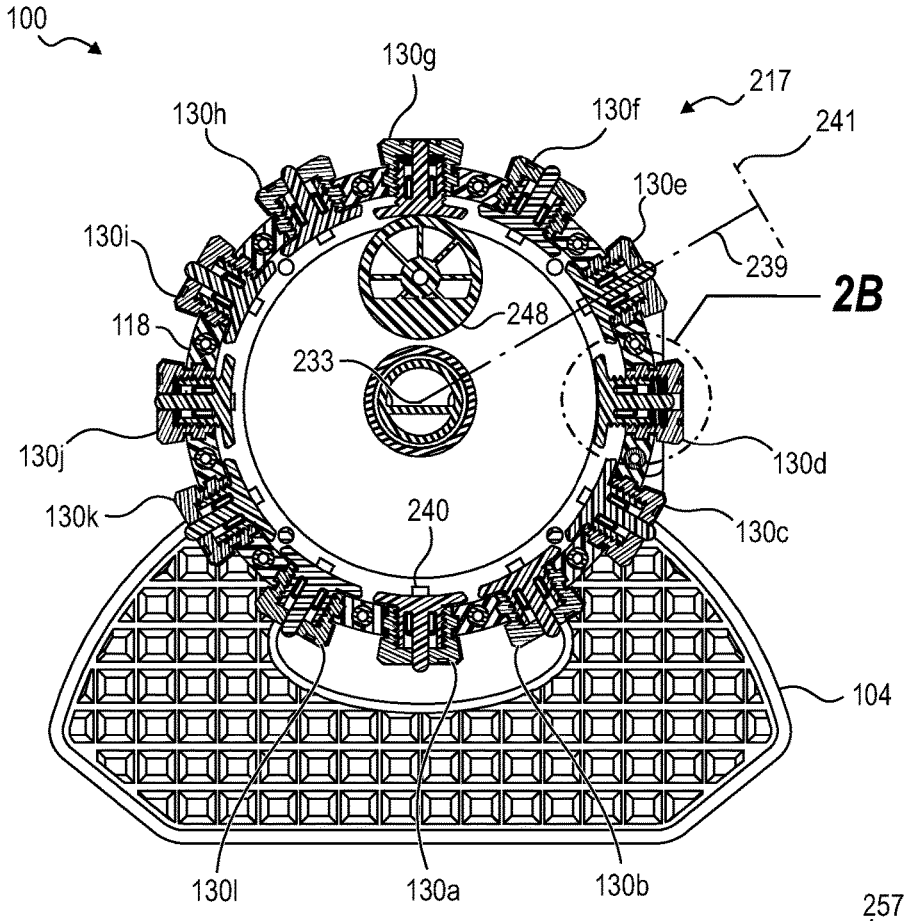
FIG. 2A is a top elevational, cross-sectional view of the irrigation sprinkler of FIG. 1B taken across the line 2A-2A in FIG. 1B.
Figure 2B:
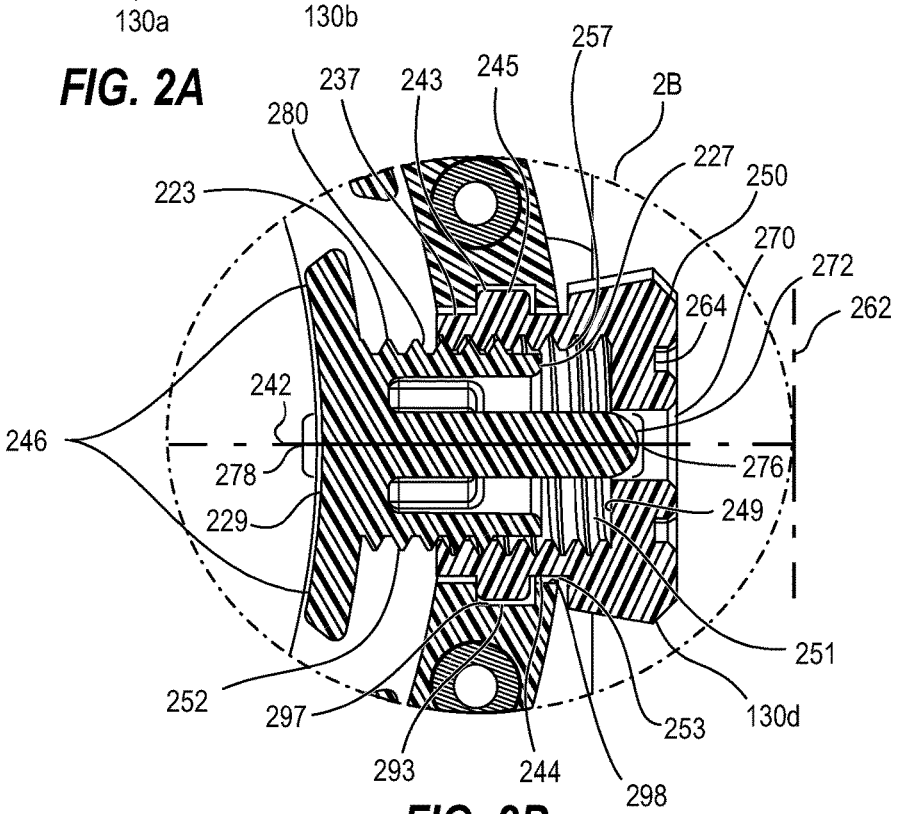
FIG. 2B is a top elevational, enlarged view of the region 2B of FIG. 2A.

FIGS. 2A and 2B will be discussed concurrently. FIG. 2A is a top elevational, cross-sectional view of the irrigation sprinkler 100 taken across the line 2A-2A in FIG. 1B. FIG. 2B is top elevational, enlarged view of the region 2B of FIG. 2A. As shown in FIG. 2A, the support plate 104 is visible. The first ring 118 may include a plurality of fins 240. Each fin 240 is proximate one of the circular recesses 253. From this top elevational, cross-sectional view, a cross section of each of the adjustment mechanisms 130*a-l* is also visible. Each adjustment mechanism 130*a-l* may be oriented along a respective radial axis. One example of a radial axis 242 is illustrated in FIG. 2B in relation to one adjustment mechanism 130*d*. Each component and feature of the sprinkler 100 may include a radial axis 239, which is an axis 239 extending radially away from a center 233 of the sprinkler 100 when seen from a top side elevational view. Each component and feature may likewise comprise a transverse axis 241, which is perpendicular to the radial axis 239. The length of an object or feature may, in various embodiments, correspond to the radial axis 239, while the width of an object or feature may correspond to a transverse axis 241 of the object or feature. It should be noted that while additional detail is provided in FIG. 2B relative to one of the adjustment mechanisms 130*a-l*, each adjustment mechanism 130*a-l* may be identical in various embodiments.

Each adjustment mechanism 130*a-l* may include an outer rotating member 250. An example of an outer rotating member 250 is illustrated in FIG. 2B. Each outer rotating member 250 may include an external surface 237 defining an annular structure 243 comprising at least one of an annular recess 244 and annular protrusion 245, and an internal surface 249 defining an internal chamber 251. The internal surface 249 defines inwardly disposed threads 257. An example of an annular structure 243 comprising at least one of an annular recess 244 and annular protrusion 245, and an internal surface 249 of an outer rotating member 250 of an adjustment mechanism 130*d* is illustrated in FIG. 2B. Each annular structure 243 may engage with one of the circular recesses 253. One example of a circular recess 253 is illustrated in FIG. 2B. In various embodiments, an inward annular structure 293 (which may comprise at least one of an inward annular recess 297 and an inward annular protrusion 298) of the circular recess 253 may be positioned to engage with the annular structure 243 of the outer rotating member 250.

The circular recess 253 may be formed by securing a portion of a first edge of the first ring 118 to a portion of a second edge of the second ring 120. The portion of the first edge that may be secured to the second edge may include the portion of the first edge that does not define a semicircular recess. Additionally or alternatively, the portion of the second edge that may be secured may include the portion of the second edge that does not define a semicircular recess. The annular structure 243 may allow rotational movement of the outer rotating member 250 and may limit radial movement (e.g., inward and outward movement along the radial axis 242, etc.) of the outer rotating member 250. More specifically, the inward annular structure 293 of the circular recess 253 may be shaped, sized, and positioned to engage with the annular structure 243 of the outer rotating member 250 such that the outer rotating member 250 may rotate with respect to the circular recess 253, and limit movement of the outer rotating member 250 relative to the circular recess 253 along the radial axis 242.

Each adjustment mechanism 130*a-l* may include an inner cylindrical member 252. An example of an inner cylindrical member 252 is illustrated in FIG. 2B. Each inner cylindrical member 252 may be oriented along a respective radial axis 242. Each inner cylindrical member 252 may include a radially inward end 278 and a radially outward end 276 disposed at opposite ends of the inner cylindrical member 252 along a radial axis 242 of the inner cylindrical member 252. Each inner cylindrical member 252 may include an outer surface 223. The outer surface 223 may define outwardly disposed threads 280 that engage the inwardly disposed threads 257 of an outer rotating member 250. The outer surface 223 may define a channel (illustrated and labeled with a reference numeral in FIG. 3B). The channel may extend radially along only a portion of the inner cylindrical member 252.

Each fin 240 may be disposed within the channel of an engaged inner cylindrical member 252. For example, each inner cylindrical member 252 may include a surrounding portion that surrounds each channel. In various embodiments, the surrounding portion may have a size and shape such that contact between the corresponding fin 240 and the surrounding portion of the engaged inner cylindrical member 252 limits rotational movement of the engaged inner cylindrical member 252. In various embodiments, the surrounding portion of each inner cylindrical member 252 may include a stop surface that defines an enclosed end of each channel. The stop surface may have a position, size, and shape to limit relative movement between the corresponding fin 240 and the engaged inner cylindrical member 252 along the radial axis 242 of the engaged inner cylindrical member 252. For example, each channel and corresponding fin 240 may allow the inner cylindrical member 252 to move radially (e.g., inwardly) to a certain extent (e.g., within a range).

In various embodiments, each outer rotating member 250 may include an outer wall 264. Each outer wall 264 may limit the radially outward movement of one of the inner cylindrical members 252. For example, each inner cylindrical member 252 may move radially within a range between an outer limit where a shoulder 227 of the inner cylindrical member 252 contacts the outer wall 264 and an inner limit where the stop surface contacts the fin 240. Each stop surface and/or fin 240 may prevent an inner cylindrical member 252 from disengaging from the inwardly disposed threads 257 and falling into the first ring 118. Each outer wall 264 may prevent an inner cylindrical member 252 from disengaging from the inwardly disposed threads 257 and falling out of the first ring 118.

In various embodiments, each outer wall 264 may define an opening 270. Each inner cylindrical member 252 may include a gauge arm 272 situated within one of the openings 270. An example of a gauge arm 272 is illustrated in FIG. 2B with respect to an adjustment mechanism 130*d*. Each gauge arm 272 may provide an indication of the degree to which the inner cylindrical member 252 is positioned radially inward or outward relative to the first ring 118. In various embodiments, each opening 270 in the outer wall 264 may be narrower (along a transverse axis 262 of the opening 270) than the portion of the outer surface 223 of the inner cylindrical member 252 defining outwardly disposed threads 280 (along a transverse axis 262 of the inner cylindrical member 272).

In various embodiments, each inner cylindrical member 252 may include a set of wings 246 disposed at the radially inward end 278. An example of a set of wings 246 is illustrated in FIG. 2B for one of the adjustment mechanisms 130*d*. In various embodiments, the set of wings 246 may comprise paired elongated extensions. In various embodiments, each set of wings 246 defines a curved surface 229 at each radially inward end 278. The sets of wings 246 may collectively define a piecewise adjustable curved surface 217 within the first ring 118 (and/or, for example, within the second ring 120).

In various embodiments, the rotational spray control mechanism 134 may engage with the piecewise adjustable curved surface 217 to control/alter flow and spray angle. For example, the rotational spray control mechanism 134 may include a wheel 248. The wheel 248 may be pivotally attached to the rotational spray control mechanism 134. As the rotational spray control mechanism 134 rotates, the wheel 248 may engage with the piecewise adjustable curved surface 217 (e.g., each inner cylindrical member 252 in sequence). As illustrated in FIG. 2A, the adjustment mechanisms 130*a-l* may be adjusted to varying degrees such that the inner cylindrical members 252 are positioned at varying depths within the first ring 118. For example, some adjustment mechanisms 130*a-c, e-f, h-i, k-l* are adjusted radially outward to an outward limit, some adjustment mechanisms 130*g, j* are adjusted between an inward limit and an outward limit, and one adjustment mechanism 130*d* is adjusted to an inward limit. As the wheel 248 rotates, the adjustment mechanisms 130*a-l* (e.g., inner cylindrical members) may deflect the wheel 248 inwardly to varying degrees. The rotational spray control mechanism 134 may control flow and/or spray angle (e.g., upward or downward spray angle) based on the degree to which the wheel 248 is deflected. Because the adjustment mechanisms 130*a-l* are individually adjustable, the flow and/or spray angle may be adjusted based on the relative position of each adjustment mechanism 130*a-l*.

FIGS. 3A-H, 4A-H, and 5A-H will be discussed concurrently. FIGS. 3A-H comprise various perspective and elevational views of an adjustment mechanism 130. FIGS. 4A-H comprise various perspective and elevational views of an outer rotating member 250 of the adjustment mechanism 130 illustrated in FIGS. 3A-H. FIGS. 5A-H comprise various perspective and elevational views of an inner cylindrical member 252 of the adjustment mechanism 130 illustrated in FIGS. 3A-H. It should be noted that, in order to avoid repetition of reference numerals, only a few instances of each feature or component discussed will be labeled with a reference number. As illustrated, each adjustment mechanism 130 may comprise an inner cylindrical member 252 disposed within an outer rotating member 250. More specifically, the inner cylindrical member 252 is disposed at least partially within the internal chamber 251 defined by the outer rotating member 250. The internal chamber 251 is defined by an internal surface 249 of the outer rotating member 250.

As explained previously, an outer surface 223 of the inner cylindrical member 252 defines a set of outwardly disposed threads 280. An internal surface 249 of the outer rotating member 250 defines a set of inwardly disposed threads 257. As illustrated in FIGS. 3A-H, the inwardly disposed threads 257 are sized, shaped, and positioned to engage the outwardly disposed threads 280 such that rotation of the outer rotating member 250 relative to the inner cylindrical member 252 results in movement of the inner cylindrical member 252 along the radial axis 242.

Again, as explained above, the outer rotating member 250 comprises an external surface 237 defining an annular structure 243 comprising at least one of an annular recess 244 and an annular protrusion 245. The annular structure 243 engages the inward annular structure 293 of the set of rings 118, 120 such that the outer rotating member 250 may rotate with respect to the set of rings 118, 120.

The outer rotating member 250 comprises an outer wall 264 defining an opening 270. As shown in FIGS. 3A-H, the gauge arm 272 may be positioned within the opening 270. The portion of the gauge arm 272 protruding out from the opening 270 indicates the relative position of the outer rotating member 250 and the inner cylindrical member 252.

As explained previously, the inner cylindrical member 252 may comprise a surrounding portion 380. The surrounding portion 380 defines and surrounds the channel 354. The channel 354, as illustrated, may be in the shape of a rectangular prism, although other shapes come within the scope of the disclosed subject matter. The channel 354 may be sized to receive one of the fins 240. The surrounding portion 380 may have a size and shape such that contact between the fin 240 and the surrounding portion 380 of an engaged one of the inner cylindrical members 252 limits rotational movement of the engaged one of the inner cylindrical members 252.

The surrounding portion 380 of each inner cylindrical member 252 comprises a stop surface 360. The stop surface 360 defines an enclosed end 531 of each channel 354. The stop surface 360 may have a position, size, and shape to limit relative movement between a fin 240 and engaged one of the inner cylindrical members 252 along the radial axis 242 of the engaged one of the inner cylindrical members 252. Radial movement in the opposite direction is limited by contact between the outer wall 264 of the outer rotating member 250 and the shoulder 227 of the inner cylindrical member 252. A more particular discussion of FIGS. 3A-H, 4A-H, and 5A-H is provided below.

Figure 3A:
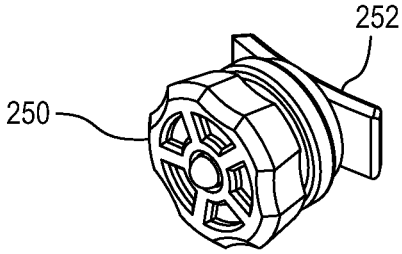
FIGS. 3A-H comprise various elevational and perspective views of an adjustment mechanism, which comprises a portion of the irrigation sprinkler of FIG. 1A, the adjustment mechanism comprising an outer rotating member coupled to an inner cylindrical member.
Figure 4A:
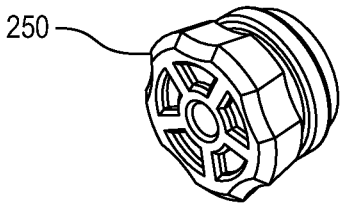
FIGS. 4A-H comprise various elevational and perspective views of an outer rotating member of the adjustment mechanism illustrated in FIGS. 3A-H.
Figure 5A:
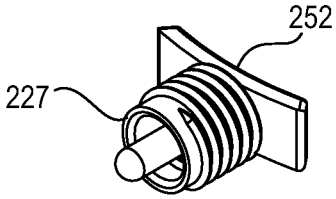
FIGS. 5A-H comprise various elevational and perspective views of an inner cylindrical member of the adjustment mechanism illustrated in FIGS. 3A-H.

FIG. 3A comprises a front perspective view of an adjustment mechanism 130. The adjustment mechanism 130 may include an outer rotating member 250 and an inner cylindrical member 252. Corresponding views of the outer rotating member 250 and the inner cylindrical member 252 are illustrated in FIGS. 4A and 5A, respectively.

Figure 3B:
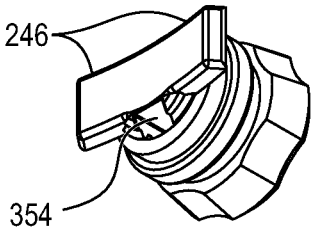
Figure 4B:
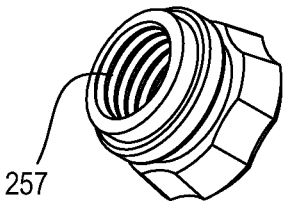
Figure 5B:
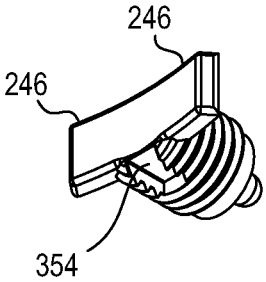

FIG. 3B is a rear perspective view of the adjustment mechanism 130. Corresponding views of the outer rotating member 250 and the inner cylindrical member 252 are illustrated in FIGS. 4B and 5B, respectively. The inner cylindrical member 252 may include a set of wings 246 disposed at the radially inward end 278. The set of wings 246 may include two or more protruding members. The protruding members may extend (e.g., widen) the inner cylindrical member 252 for engaging a rotational spray control mechanism 134 (illustrated in FIG. 1A). For example, the set of wings 246 may allow a smoother and/or more continuous engagement with the rotational spray control mechanism 134 during rotation.

The outer rotating member 250 may include an internal surface 249 defining an internal chamber 251. The internal surface 249 may include inwardly disposed threads 257.

An outer surface 223 of the inner cylindrical member 252 may define a channel 354. For example, the inner cylindrical member 252 may include a surrounding portion 380 that surrounds and defines the channel 354. In various embodiments, the channel 354 may be in the shape of a rectangular prism with rounded edges.

Figure 3C:
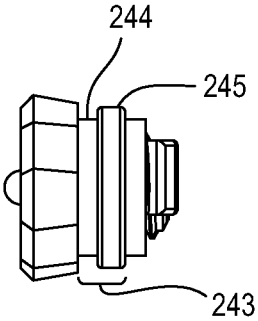
Figure 4C:
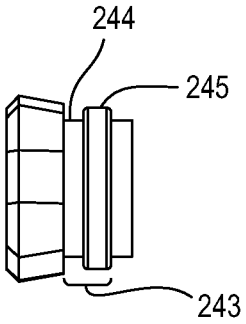
Figure 5C:
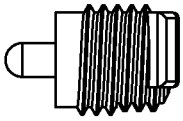

FIG. 3C is a first side elevational view of the adjustment mechanism 130. Corresponding views of the outer rotating member 250 and the inner cylindrical member 252 are illustrated in FIGS. 4C and 5C, respectively. The outer rotating member 250 of the adjustment mechanism 130 may include an external surface 237 defining an annular structure 243 comprising at least one of an annular recess 244 and annular protrusion 245. The annular structure 243 may be positioned to engage with a circular recess 253 of the irrigation sprinkler 100. The annular structure 243 may allow rotational movement of the outer rotating member 250 relative to the circular recess 253 and may limit radial movement of the outer rotating member 250 relative to the circular recess 253.

Figure 3D:
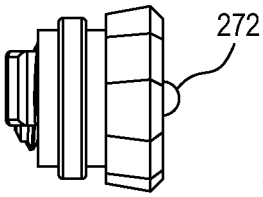
Figure 4D:
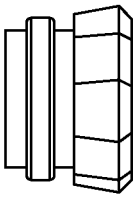
Figure 5D:
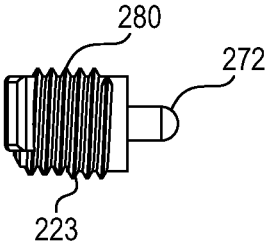

FIG. 3D is a second side elevational view of the adjustment mechanism 130. Corresponding views of the outer rotating member 250 and the inner cylindrical member 252 are illustrated in FIGS. 4D and 5D, respectively. The inner cylindrical member 252 may include an outer surface 223. The outer surface 223 may define outwardly disposed threads 280. The outwardly disposed threads 280 may engage the inwardly disposed threads 257 of the outer rotating member 250. The inner cylindrical member 252 may include a gauge arm 272.

Figure 3E:
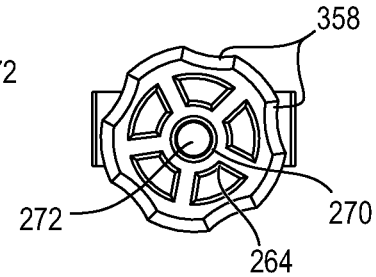
Figure 4E:
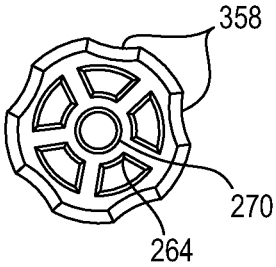
Figure 5E:
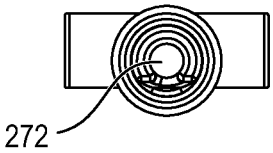

FIG. 3E is a radially-outward-end elevational view of the adjustment mechanism 130. Corresponding views of the outer rotating member 250 and the inner cylindrical member 252 are illustrated in FIGS. 4E and 5E, respectively. The outer rotating member 250 may include an outer wall 264. The outer wall 264 may define an opening 270. The inner cylindrical member 252 may include the gauge arm 272 situated in the opening 270.

In various embodiments, the external surface 237 of the outer rotating member 250 may include an outward manipulation surface. The outward manipulation surface may define a plurality of indentations 358. The indentations 358 may facilitate manual rotation of the outer rotating member 250. The indentations 358 may be omitted in certain embodiments or, may be configured in alternative shapes (e.g., a V-shaped indentation rather than a rounded indentation 358).

Figure 3F:
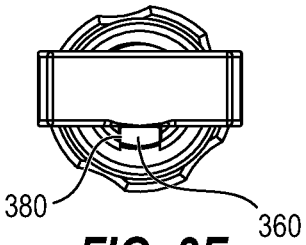
Figure 4F:
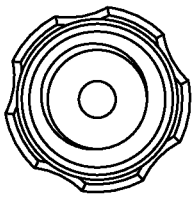
Figure 5F:
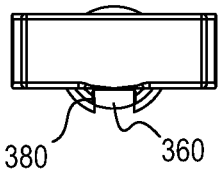

FIG. 3F is a radially-inward-end elevational view of the adjustment mechanism 130. Corresponding views of the outer rotating member 250 and the inner cylindrical member 252 are illustrated in FIGS. 4F and 5F, respectively. The inner cylindrical member 252 may include a surrounding portion 380 surrounding the channel 354. The surrounding portion 380 may include a stop surface 360 to limit relative movement between the inner cylindrical member 252 and a fin 240.

Figure 3G:
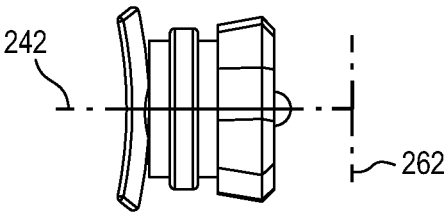
Figure 4G:
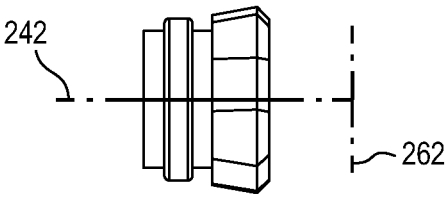
Figure 5G:
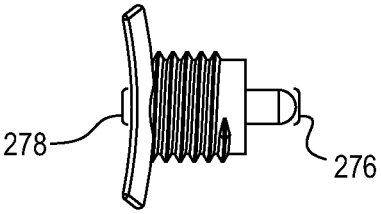

FIG. 3G is a top side elevational view of the adjustment mechanism 130. Corresponding views of the outer rotating member 250 and the inner cylindrical member 252 are illustrated in FIGS. 4G and 5G, respectively. The adjustment mechanism 130 may comprise a radial axis 242. The inner cylindrical member 252 may include a radially inward end 278 and a radially outward end 276 disposed at opposite ends of the inner cylindrical member 252 along the radial axis 242. A transverse axis 262 may also be defined perpendicular to the radial axis 242. In various embodiments, the set of wings 246 may protrude in an arcuate pathway along the transverse axis 262 from the radial axis 242.

Figure 3H:
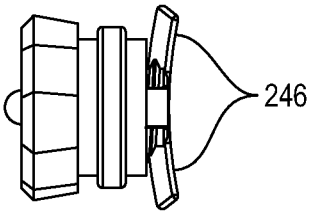
Figure 4H:
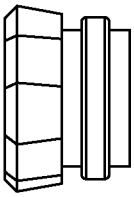
Figure 5H:
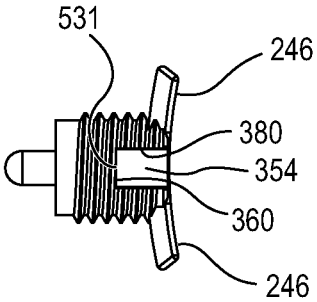

FIG. 3H is a bottom elevational view of the adjustment mechanism 130. Corresponding views of the outer rotating member 250 and the inner cylindrical member 252 are illustrated in FIGS. 4H and 5H, respectively. In various embodiments, the set of wings 246 may define a curved, concave surface 229 at the radially inward end 278 of the inner cylindrical member 252. In various embodiments, the channel 354 may be disposed on the bottom, or lower surface, of the inner cylindrical member 252. The surrounding portion 380 may include the stop surface 360.

Figure 6:
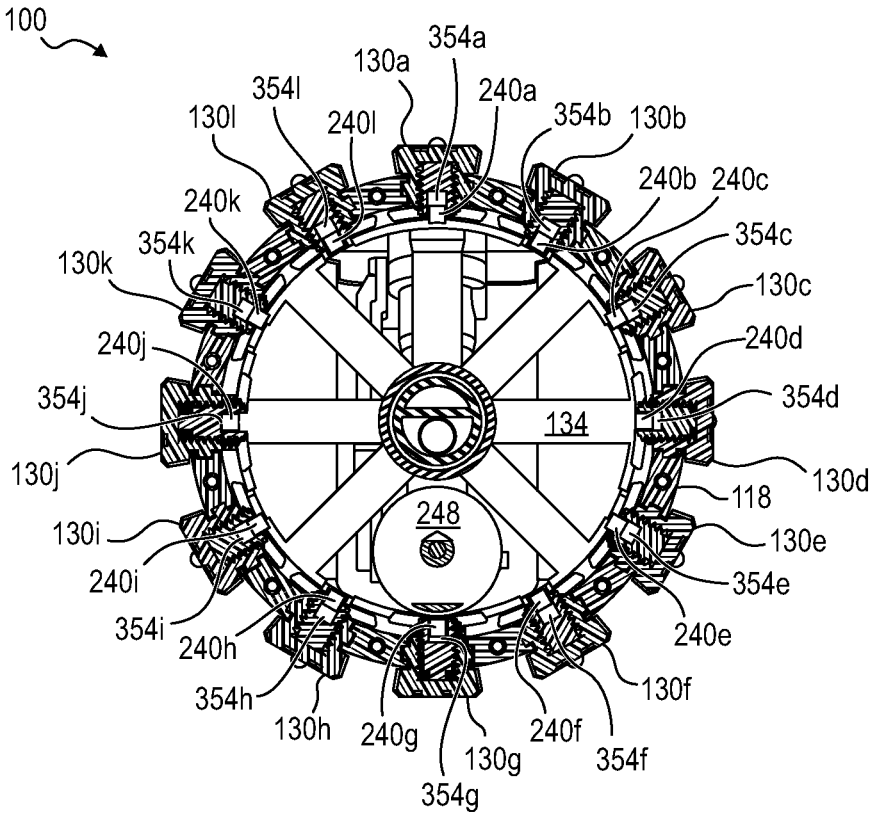
FIG. 6 is a bottom elevational, cross-sectional view of the irrigation sprinkler taken across the line 6-6 in FIG. 1B.

FIG. 6 is a diagram illustrating a bottom elevational, cross-sectional view of the irrigation sprinkler 100 shown in FIG. 1B across the line 6-6. In particular, FIG. 6 illustrates a plurality of adjustment mechanisms 130*a-l*. A first ring 118 of the irrigation sprinkler 100 may include a plurality of fins 240*a-l*. Channels 354*a-l* may be defined by each outer surface 223 of an inner cylindrical member 252 for each adjustment mechanism 130*a-l*. A wheel 248 of the rotational spray control mechanism 134 may engage the adjustment mechanisms 130*a-l*.

Figure 7A:
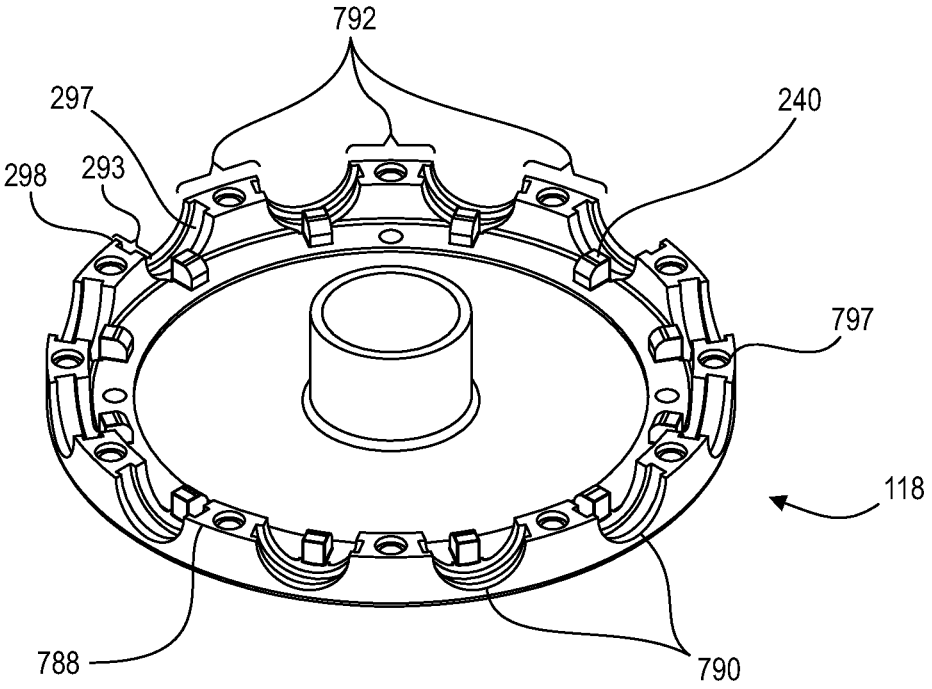
FIG. 7A is a perspective view of the first ring of the irrigation sprinkler of FIG. 1A.

FIG. 7A is a perspective view of the first ring 118 of the irrigation sprinkler 100. The first ring 118 may include a first edge 788 defining a plurality of semicircular recesses 790. A portion 792 of the first edge 788 (e.g., all of the peaked parts of the first edge 788) may be secured to a portion of the second ring 120. In various embodiments, the first ring 118 may include fins 240. In various embodiments, the first edge 788 may define and/or include a plurality of holes 797. The holes 797 may align with posts included in the second ring 120 (e.g., the second edge 794).

Figure 7B:
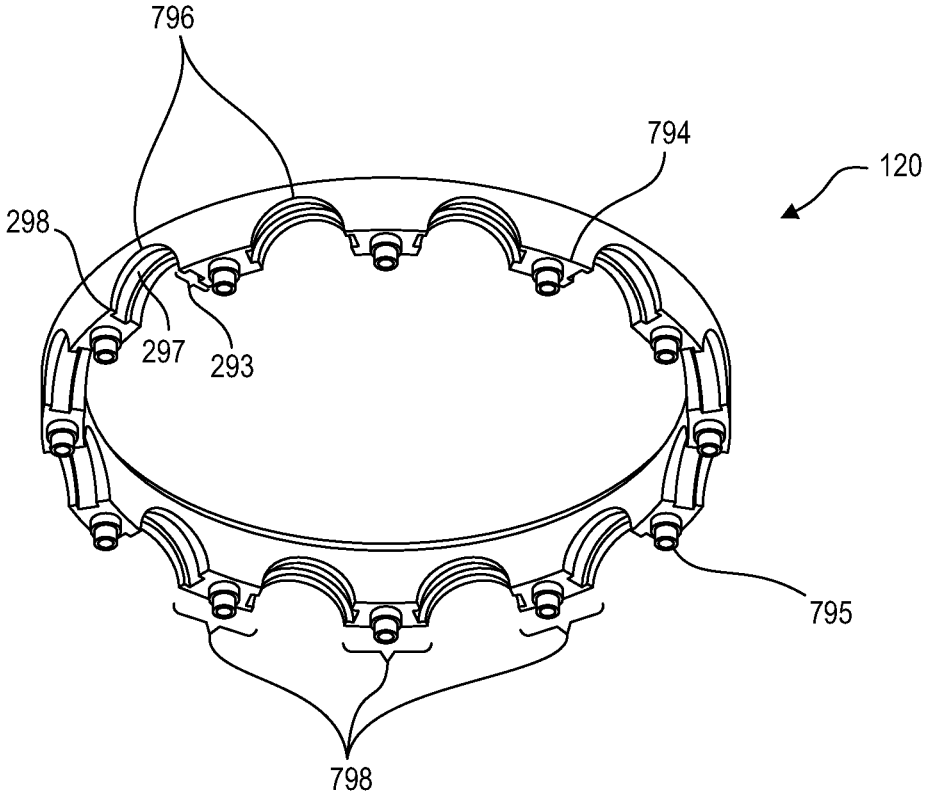
FIG. 7B is a perspective view of the second ring of the irrigation sprinkler of FIG. 1A.

FIG. 7B is a perspective view of the second ring 120 of the irrigation sprinkler 100. The second ring 120 may include a second edge 794 defining a second plurality of semicircular recesses 796. A portion 798 of the second edge 794 (e.g., all of the peaked parts of the second edge 794) may be secured to a portion 792 of the first edge 788 of the first ring 118. In various embodiments, the second edge 794 may define and/or include a plurality of posts 795. When secured together, the posts 795 of the second edge 794 may be disposed within the holes 797 of the first edge 788.

FIGS. 7A-B illustrate that the semicircular recesses 790, 796 may comprise inward annual structure 293 including at least one of an inward annular recess 297 and an inward annular protrusion 298. The inward annular structure 293 may be shaped in size to engage with the annular structure 243 of the outer rotating member 250 such that the outer rotating member 250 may rotate with respect to the first and second rings 118, 120. Of course, as the rings 118, 120 are not yet assembled as illustrated in FIG. 7A-7B; accordingly, the inward annular structure 293 is shown in an unassembled state in these figures.

Figure 8:
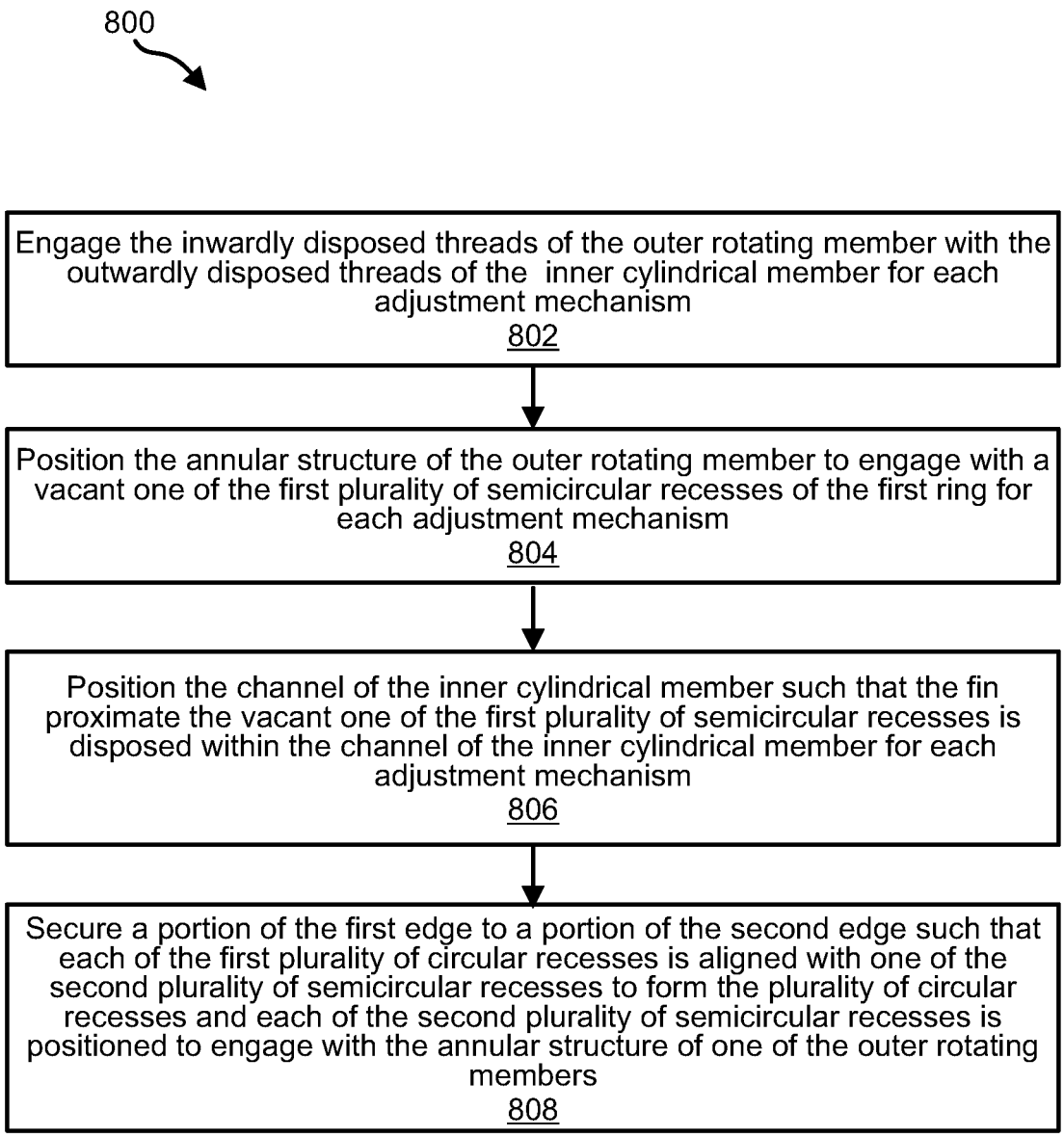
FIG. 8 is a flow diagram illustrating one embodiment of a method of manufacturing the irrigation sprinkler.

FIG. 8 is a flow diagram illustrating one embodiment of a method of manufacturing the irrigation sprinkler 100. The method 800 may include engaging 802 the inwardly disposed threads 257 of the outer rotating member 250 with the outwardly disposed threads 280 of the inner cylindrical member 252 for each adjustment mechanism 130.

The method 800 may also include positioning 804 the annular structure 243 of the outer rotating member 250 to engage with a vacant one of the first plurality of semicircular recesses 790 of the first ring 118 for each adjustment mechanism 130. The method 800 may further include positioning 806 the channel 354 of the inner cylindrical member 252 such that the fin 240*a-l* proximate the vacant one of the first plurality of semicircular recesses 790 is disposed within the channel 354 of the inner cylindrical member 252 for each adjustment mechanism 130. The method 800 may additionally include securing 808 a portion of the first edge 788 to a portion of the second edge 794 such that each of the first plurality of semicircular recesses 790 is aligned with one of the second plurality of semicircular recesses 796 to form the plurality of circular recesses 253 and such that each of the second plurality of semicircular recesses 796 is positioned to engage with an annular structure 243 of one of the outer rotating members 250. For example, a portion of the first edge 788 and a portion 798 of the second edge 794 may be secured together with, for example, vibration welding, adhesive, press fit, snap fit and/or other securing mechanism or means. In various embodiments, the securing 808 process may encompass ultrasonic welding a portion of the first edge 788 to a portion of the second edge 794.

It should be noted that one or more of the steps of the method 800 may be performed in a different order and/or may be performed concurrently and/or simultaneously with one or more other steps. For example, the channel 354 may be positioned 806 such that the fin 240*a-l* is disposed within the channel 354 or the fin 240 may be positioned such that it aligns with the channel 354. In another example, each step may be performed concurrently for all of the adjustment mechanisms 130*a-l*.

It is understood that any specific order or hierarchy of steps in any disclosed process is an example of a sample approach. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the scope of the disclosure. Thus, the present disclosure is not intended to be limited to the aspects shown herein but is to be accorded the widest scope consistent with the principles and novel features disclosed.

What is claimed is:

1. An irrigation sprinkler, comprising:

a first ring comprising a first edge defining a first plurality of semicircular recesses;

a second ring comprising a second edge defining a second plurality of semicircular recesses, wherein a portion of each of the first edge and the second edge are shaped and sized to be secured together, wherein the first ring and the second ring are secured together with each of the first plurality of semicircular recesses aligned with one of the second plurality of semicircular recesses to define a plurality of circular recesses, and wherein the first ring comprises a fin proximate each circular recess; and an adjustment mechanism disposed within each of the circular recesses, wherein each adjustment mechanism comprises:

an outer rotating member comprising an external surface defining an annular structure comprising at least one of an annular recess and an annular protrusion, and an internal surface defining an internal chamber, wherein the internal surface comprises inwardly disposed threads;

an inner cylindrical member comprising an outer surface, wherein the inner cylindrical member comprises a radially inward end and a radially outward end disposed at opposite ends of the inner cylindrical member along a radial axis of the inner cylindrical member, wherein the outer surface defines outwardly disposed threads that engage the inwardly disposed threads and the outer surface defines a channel, the channel extending radially along only a portion of the inner cylindrical member, wherein each fin is disposed within the channel of an engaged one of the inner cylindrical members.

2. The irrigation sprinkler of claim 1, wherein each inner cylindrical member comprises a surrounding portion that surrounds each channel, the surrounding portion having a size and shape such that contact between the fin and the surrounding portion of the engaged one of the inner cylindrical members limits rotational movement of the engaged one of the inner cylindrical members.

3. The irrigation sprinkler of claim 2, wherein the surrounding portion of each inner cylindrical member comprising a stop surface that defines an enclosed end of each channel, the stop surface having a position, size, and shape to limit relative movement between the fin and the engaged one of the inner cylindrical members along the radial axis of the engaged one of the inner cylindrical members.

4. The irrigation sprinkler of claim 1, wherein each inner cylindrical member comprises a set of wings disposed at the radially inward end.

5. The irrigation sprinkler of claim 4, wherein each set of wings defines a curved surface at each radially inward end, and wherein the sets of wings collectively define a piecewise adjustable curved surface within the first ring and the second ring.

6. The irrigation sprinkler of claim 5, further comprising a rotational spray control mechanism, wherein the rotational spray control mechanism engages with the piecewise adjustable curved surface to control flow and spray angle.

7. The irrigation sprinkler of claim 1, wherein each annular structure engages with one of the circular recesses allowing rotational movement of each outer rotating member and limiting radial movement of each outer rotating member.

8. The irrigation sprinkler of claim 1, wherein the external surface of each outer rotating member comprises an outward manipulation surface, the outward manipulation surface defining a plurality of indentations.

9. The irrigation sprinkler of claim 1, each outer rotating member comprising an outer wall defining an opening, wherein each inner cylindrical member comprises a gauge arm situated within one of the openings.

10. The irrigation sprinkler of claim 9, wherein each opening is smaller than each outer surface defining outwardly disposed threads.

11. A method of manufacturing the irrigation sprinkler of claim 1, comprising:

for each of the adjustment mechanisms:

engaging the inwardly disposed threads of the outer rotating member with the outwardly disposed threads of the inner cylindrical member;

positioning the annular structure to engage with a vacant one of the first plurality of semicircular recesses of the first ring; and positioning the channel of the inner cylindrical member such that the fin proximate the vacant one of the first plurality of semicircular recesses is disposed within the channel of the inner cylindrical member; and after one of the adjustment mechanisms is positioned within each one of the first plurality of semicircular recesses:

securing a portion of the first edge to a portion of the second edge such that:

each of the first plurality of semicircular recesses is aligned with one of the second plurality of semicircular recesses to form the plurality of circular recesses; and each of the second plurality of semicircular recesses is positioned to engage with the annular structure of one of the outer rotating members.

12. An irrigation sprinkler, comprising:

a first ring comprising a first edge defining a first plurality of semicircular recesses;

a second ring comprising a second edge defining a second plurality of semicircular recesses, wherein a portion of each of the first edge and the second edge are shaped and sized to be secured together, wherein the first ring and the second ring are secured together with each of the first plurality of semicircular recesses aligned with one of the second plurality of semicircular recesses to define a plurality of circular recesses, and wherein the first ring comprises a fin proximate each circular recess; and an adjustment mechanism disposed within each of the circular recesses, wherein each adjustment mechanism comprises:

an outer rotating member comprising an external surface defining an annular structure comprising at least one of an annular recess and an annular protrusion, and an internal surface defining an internal chamber, wherein the internal surface comprises inwardly disposed threads;

an inner cylindrical member comprising an outer surface, wherein the inner cylindrical member comprises a radially inward end and a radially outward end disposed at opposite ends of the inner cylindrical member along a radial axis of the inner cylindrical member, wherein the outer surface defines outwardly disposed threads that engage the inwardly disposed threads and the outer surface defines a channel, the channel extending radially along only a portion of the inner cylindrical member, wherein the external surface of each outer rotating member comprises an outward manipulation surface, the outward manipulation surface defining a plurality of indentations.

* * * * *